US005123560A

United States Patent [19]

Arzani et al.

[11] Patent Number: 5,123,560

[45] Date of Patent: Jun. 23, 1992

[54] TWO-CHAMBER DISPENSER FOR A GAS-PRESSURIZED OR NON-PRESSURIZED PACKAGE

[75] Inventors: Ferruccio Arzani; Sergio Bodega, both of Fribourg; Olivier Y. Muggli, Neuhausen; Jean Hardt, Benken, all of Switzerland

[73] Assignee: Alusuisse-Lonza Services Ltd., Zurich, Switzerland

[21] Appl. No.: 467,809

[22] Filed: Jan. 19, 1990

[30] Foreign Application Priority Data

Jan. 31, 1989 [CH] Switzerland ..... 334/89

[51] Int. Cl.[5] ..... B65B 3/04

[52] U.S. Cl. ..... 222/95; 222/105

[58] Field of Search ..... 222/94, 95, 402.1, 402.13, 222/92, 107, 105, 386.5, 389; 156/69, 244.11; 428/35.2, 35.3, 35.4; 141/3, 20, 114

[56] References Cited

U.S. PATENT DOCUMENTS

| | | | |
|---|---|---|---|
| 4,089,443 | 5/1978 | Zrinyi | 222/386.5 |
| 4,346,743 | 8/1982 | Miller | 222/386.5 |
| 4,545,506 | 10/1985 | Kadono | 222/402.21 |
| 4,759,472 | 7/1988 | Strenger | 222/92 |

FOREIGN PATENT DOCUMENTS

| | | |
|---|---|---|
| 0105537 | 4/1984 | European Pat. Off. . |
| 0131204 | 5/1985 | European Pat. Off. . |
| 2342222 | 9/1977 | France . |
| 2371238 | 6/1978 | France . |

*Primary Examiner*—Michael S. Huppert
*Assistant Examiner*—Philippe Derakshani
*Attorney, Agent, or Firm*—Bachman & LaPointe

[57] ABSTRACT

The two-chamber dispenser comprises a rigid or semi-rigid one piece can body with a shoulder forming a flanged opening and a flexible pouch which is inserted inside and is made of a material for providing a diffusion barrier. The dispenser is for liquid, pasty or creamy contents. The pouch is made of a laminate and features a neck in the region of the flange. The flange is suitable for clinching on a valve or pump plate after filling.

19 Claims, 4 Drawing Sheets

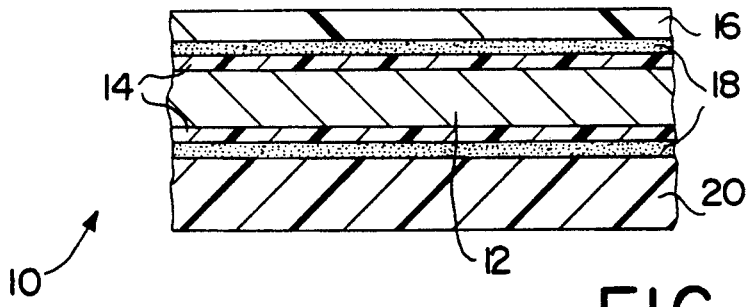
FIG. 1
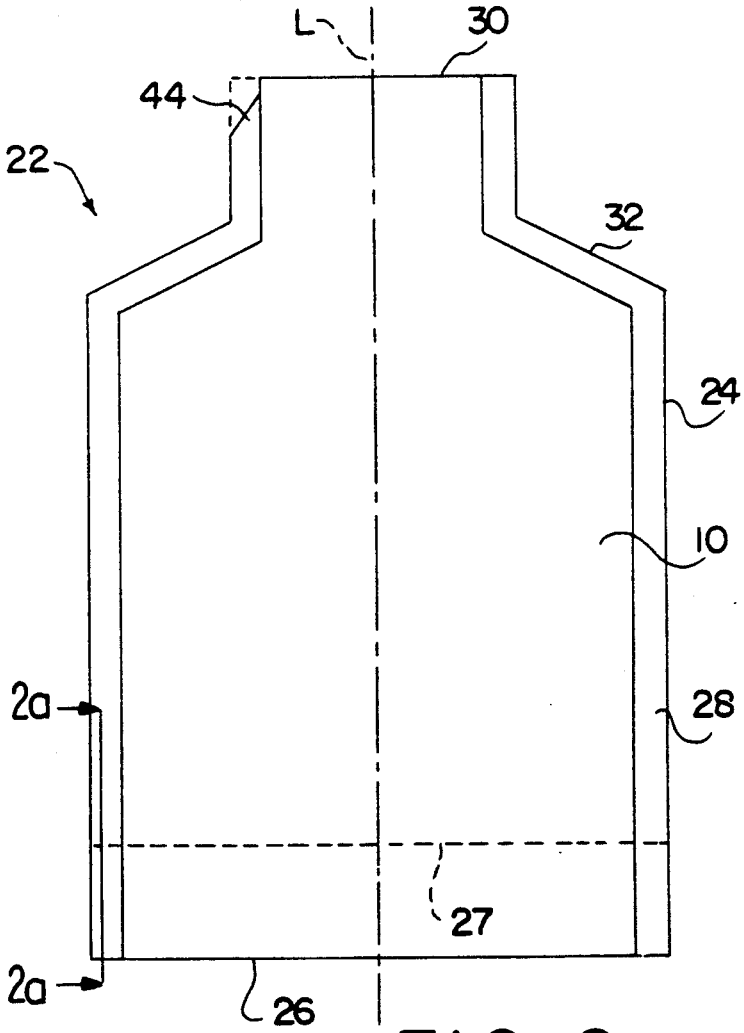
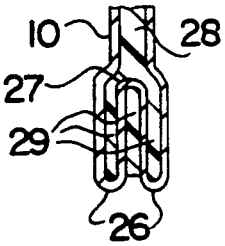
FIG. 2a
FIG. 2

TWO-CHAMBER DISPENSER FOR A GAS-PRESSURIZED OR NON-PRESSURIZED PACKAGE

BACKGROUND OF THE INVENTION

The invention relates to a two-chamber dispenser for a gas-pressurized or non-pressurized package, said dispenser comprising a rigid or semi-rigid one-piece can body with a shoulder forming a flanged opening and inserted therein a flexible inner pouch (herein after simply pouch) of a material which forms a barrier to diffusion, said pouch being for liquid, pasty or creamy contents.

There are various two-chamber dispensers for gas-pressurized and non-pressurized packages which permit separation of a propellant from the contents.

In the case of one two-chamber package a pressure-resistant can body contains a flexible, folded or semi-rigid pouch which can be deformed radially and/or axially. The pressure of the propellant between the pouch and the can body is so great that on opening the valve the liquid, pasty or creamy contents are expelled from the container. For environmental reasons the main propellant gases used today are nitrogen, air and liquid methane, which are fed or forced into the container through a sealable hole in the base of the can body.

By using a pump facility, which for physical reasons is particularly suitable for low viscosity fluids, the contents are sucked out of the pouch. There is no excess pressure in the space between the flexible pouch and the can body. The contents removed from the pouch cause the volume of the pouch to become smaller; the resultant negative pressure is constantly equalized.

Known versions of two-chamber dispensers for gas-pressurized and non-pressurized packages exhibit the following disadvantages:

The resistance to diffusion is not sufficient, either because the material used does not provide an adequate barrier, or because the connection of the pouch to the valve or pump facility is not sufficiently airtight.

The material necessary to provide a perfect barrier to diffusion e.g. in the form of an aluminum sleeve, is too thick. Under the action of radial compression the residual volume is large, which results in a loss of material i.e. contents. Axial compression is not possible here. Furthermore, under the action of radial deformation kinking or buckling can occur producing stresses that could lead to perforation (British Patent Document 2162901.)

The pouches are secured in a complicated manner e.g. in two-part can bodies.

Known two-chamber dispensers are very expensive making the final product difficult to sell.

The object of the present invention is to develop a two-chamber dispenser of the kind discussed above which is diffusion-proof also in the region of transition to the valve or pump, even with critical products and this for several years, at the same time permitting manufacture at a favorable cost. Furthermore, the residual volume which is left in the pouch after emptying should be small. Finally, and this is of particular importance, the filling operation should save the introduction and attachment of the pouch to the can body.

SUMMARY OF THE INVENTION

This object is achieved by way of the invention in that the pouch is made of a laminate, and in the region of the flange features a neck, said flange being suitable after filling for clinching a valve or pump plate.

A result of the two-chamber dispenser according to the invention is that the company performing the filling operation need no longer carry out the relatively time-consuming operation of introducing and securing the pouch in the can body; after the filling operation the filler must only clinch the valve or pump plate and, if it is a two-chamber compression-type of package, to inject the gas into it. This represents a significant simplification and therefore savings in investment and operating costs for a filling firm.

The flexible pouch in the interior of the two-chamber dispenser is preferably made of a one-piece, folded length of laminate that is cut or stamped out of a continuous strip of foil and folded or turned. Outwith the opening for the contents the cut or bent-over edges are sealed, adhesively bonded or welded forming a seam some millimeters wide. Inclined regions are preferably formed on both sides of the opening for the contents and usefully correspond approximately with the shoulders of the can body.

The flexible pouch preferably features a core layer of aluminum or a ductile aluminum alloy. Instead of a metallic core layer, a plastic such as polyamide, ethyl-vinyl-alcohol or polyvinylchloride can be employed as a barrier or for resistance to diffusion. At least on one side, the inner side, the core layer features a sealable plastic layer. This can be sealed to itself or to other plastics. The neck of the pouch can basically be of two different kinds viz., as an inserted transition piece or as a shaped collar which is a component part of the multi-layer pouch.

According to the first version the transition piece, forming the neck and made of injection molded plastic, is adhesively bonded, sealed or welded over its whole surface into the opening of the flexible pouch. The laminate forming the pouch preferably extends up to the connection the transition piece makes with the flanging of the can body. This ensures that no or only a negligibly small amount of diffusion of propellant gas can take place through the plastic transition piece, in particular if compressed air which contains aggressive oxygen is to be separated for years from sensitive contents only by the pouch.

The transition piece is preferably of polyethylene (PE) or polypropylene (PP). The ring-shaped wall of the transition piece is usefully made as a coextruded layer with diffusion barrier properties. A separately or additionally deposited metallized surface layer improves the diffusion barrier properties of the transition piece further.

A second version is such that the neck of the pouch can be shaped out of a collar of the laminate; with this version the transition piece or a shaped collar of the pouch is clamped tightly and sealed in an inward lying flanging of the can body.

The laminate, as interior pouch for a can body with a transition piece or with a directly-attached shaped-laminate, meets all the necessary requirements. The laminate is flexible, available with the necessary dimensions, is chemically inert and physically stable, can be shaped by forming and adhesively bonded, sealed or welded. The two-chamber dispenser according to the invention can as a whole be manufactured at moderate cost. All standardized valve or pump plates can be clinched onto the flanging of the dispenser.

BRIEF DESCRIPTION OF THE DRAWINGS

The invention is explained in greater detail in the following drawings with the aid of exemplified embodiments illustrated schematically.

FIG. 1 shows a cross-section through a laminate of a pouch.

FIG. 2 shows a view of a pouch of a laminate according to FIG. 1.

FIG. 2a shows section IIa—IIa through the folded region of the pouch according to FIG. 2.

DETAILED DESCRIPTION

Figure 3:
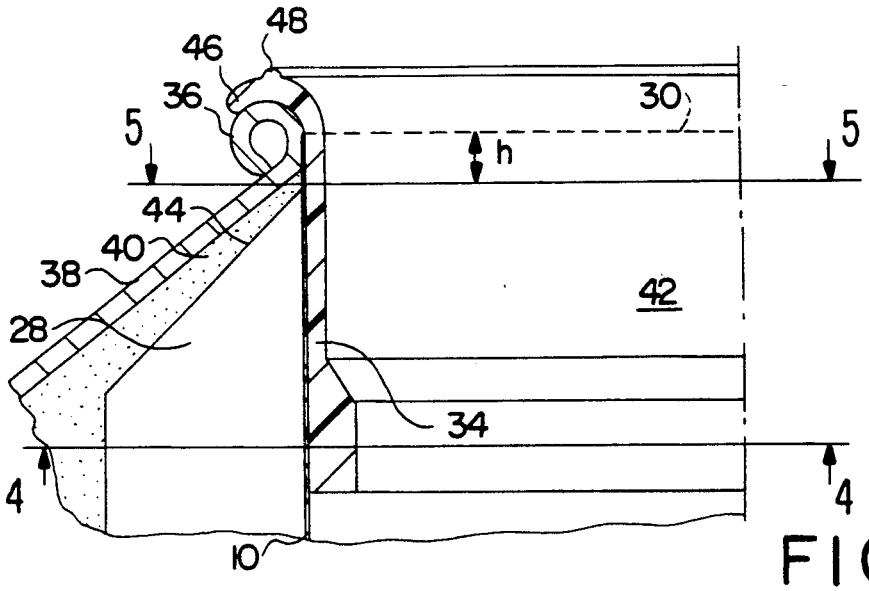
FIG. 3 shows a cross-sectional view of a part of a two-chamber dispenser with pouch inserted in the interior.

Shown in FIG. 1 is a laminate 10 for manufacturing a dispenser pouch; the said laminate has an approximately 9–30 μm thick core layer 12 of pure aluminum, painted on both sides with a primer 14. On the upper side, later the outside of the pouch, is an outer layer 16 which is bonded-on by means of an adhesive 18. On the lower side, likewise attached by means of an adhesive 18, is the, later, inside layer 20. The outer layer 16 of polyethylene-terephthalate (PET) is about 12–30 μm thick, the inner layer 20 of polyethylene (PE) is about 30–50 μm thick. The total thickness of the laminate is about 70–20 μm.

According to a version of the laminate 10 not shown here a further layer of plastic can be provided between the adhesive 18 and the inner layer 20, said plastic layer corresponding to the outer layer 16 and improving the resistance to kinking.

The pouch 22 illustrated in FIG. 2 has been cut-out or stamped-out of a strip of laminate 10 as shown in FIG. 1. The cut or stamped edges 24 of the laminate 10 bent along the three edges, 27 are, with the exception of the pouch opening 30 and along bending line 27, joined together via sealed seams 28. For simplicity, both here and in the following, adhesively bonded or welded seams will also be described as sealed seams 28.

The region of the pouch 22 lying opposite the opening 30 is folded and sealed in a conventional manner such that the base can extend outwards as the contents are added. The sealing in this region is indicated in FIG. 2a by the section along line IIa—IIa in FIG. 2. The laminate 10 is folded three times along lines 26, 27 and joined together by forming sealed seams 28, 29. Outside the region of the sealed seams 28 running in the longitudinal direction of the pouch 22 the folds shown in FIG. 2a are pushed apart by the addition of the contents, as the middle of the lower three sealed seams 29 is missing and the outer seams are formed only in the lowest region.

In the region of the pouch opening, as indicated on one side by a dotted line, the sealed seam 28 is cut or stamped out with an incline 44. The incline 32 is preferably made with a shape and slope corresponding approximately to that of the shoulder of the can body.

The laminate 10 shown in FIG. 3 on a transition piece 34, an injection molded part of plastic, extends from the outwards-lying flange 36 on the can body 38. The laminate 10 is adhesively bonded over its whole surface to the cylindrical mantel of the transition piece 34, whereby the sealed seams 28 of the pouch 22 stand out approximately radially. The removing of the uppermost region of the sealed seam 28, as indicated in FIG. 2, makes it possible to draw the laminate 10 sufficiently high. This laminate 10, which is highly effective against diffusion, ensures that below the outward lying flange 36, also in the region the propellant gas 40 situated between the can body 38 and the contents 42 in the pouch 22, does not diffuse through the transition piece 34 and cause damage to the contents 42.

The height h of removed seam 28 of pouch 22 below the opening 30 is kept as small as possible; in practice it amounts to 1–5 mm, preferably 1–2 mm. Conforming with this, the incline 44 of the sealed seam 28 is chosen such that the height h can be kept small with all normal shoulder shapes and inclinations on the can body 38.

The transition piece 34 is shaped in the upper region 46 such that it can be laid over the outward lying flange 36 and adhesively bonded to it. The mold for the transition piece 34 is, furthermore, designed such that a ring-shaped, projection 48 for sealing is provided, said projection providing tightly sealed clinching of a valve or pump plate.

Figure 4:
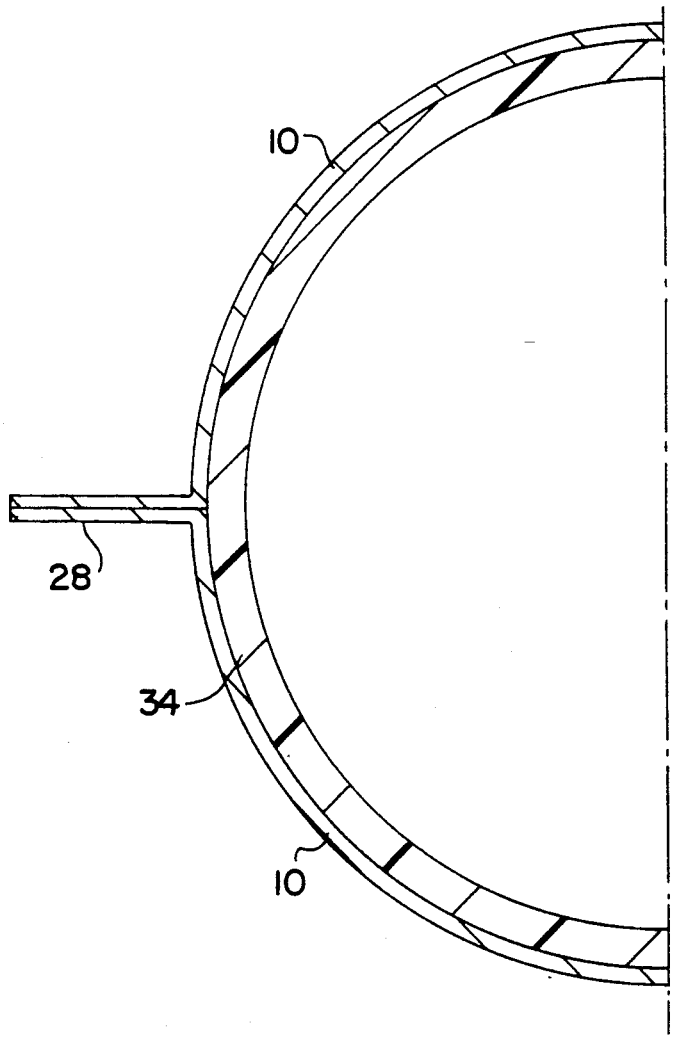
FIG. 4 shows a horizontal section along line IV—IV in FIG. 3.

The horizontal section shown in FIG. 4 shows the ring-shaped transition piece 34 and the two part laminate 10 of the pouch 22 sealed onto it. Both laminates 10 are adhesively bonded together in the region of the approximately radially outward-lying, sealed seam 28.

The laminate 10 is mounted in a conventional manner with heated clamping plates or sealing plates and silicone rubber stamp which is introduced into the interior of the transition piece 34 and acts as a quasi-hydraulic medium. Furthermore, the laminate can be shrunk onto the transition piece 34, likewise in a conventional manner.

Figure 5:
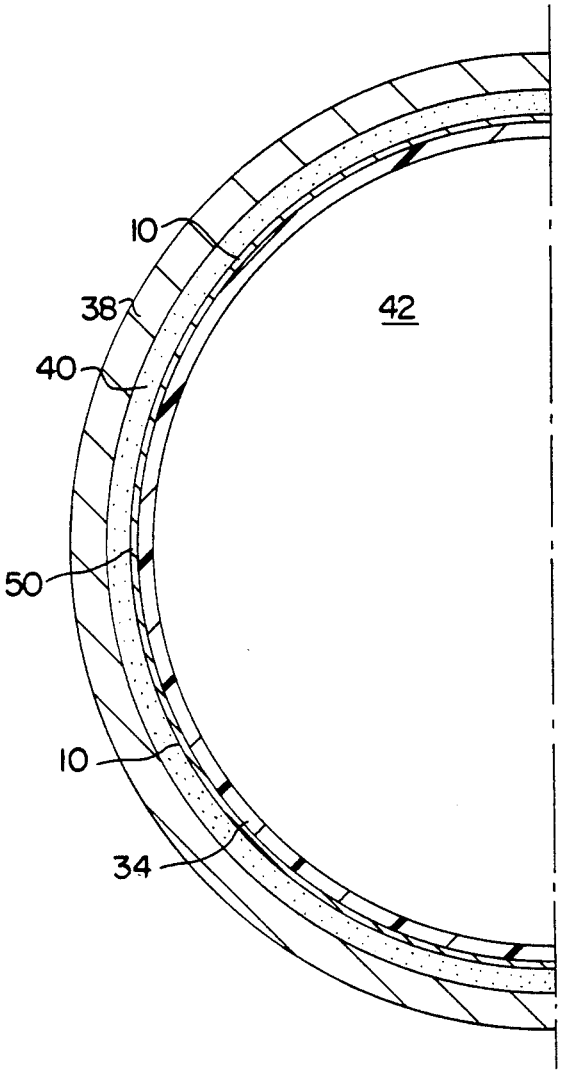
FIG. 5 shows a horizontal section along line V—V in FIG. 3.

In the horizontal section shown in FIG. 5, the sealed seam 28 (FIG. 3) has been removed. As a result there is a region of contact 50 of the two halves of the laminate 10, in which the laminate 10 closes without forming a perfect seal. Although this is a weak point, the protective action of the laminate is, on the whole and in comparison with known versions, extremely high. The otherwise ring-shaped unprotected region of the transition piece has, according to the invention, been reduced to two narrow mantel lines, which makes the diffusion of the propellant gas 40, situated between the can body 38 and the transition piece 40, to the contents 42 practically negligable.

Figure 6:
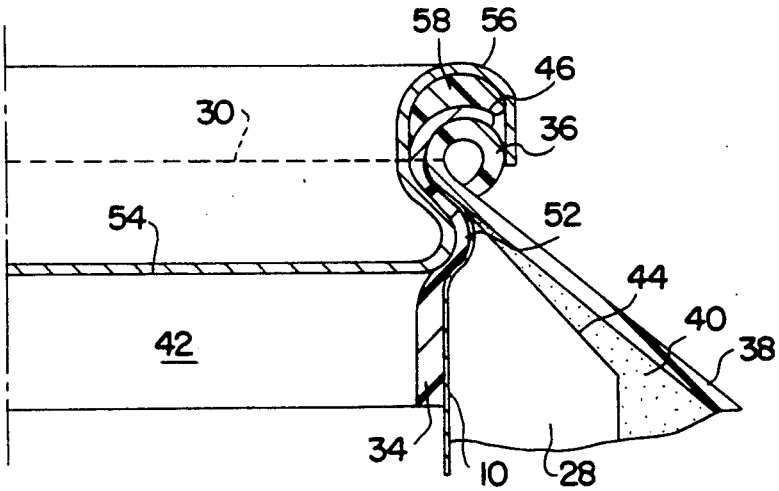
FIG. 6 shows a cross-section through a version of a two-chamber dispenser with pouch inserted in the interior.

Another version of that shown in FIG. 3 is shown in FIG. 6. The laminate 10 again runs over a transition piece 34, which features a bulge 52 running round it, up to the outward lying flange 36 and is shaped like the transition piece 34. The pouch opening 30 which indicates the position of the laminate 10 is shown by a broken line.

The opening in the can is clinched to a valve or pump plate 54. A seal 58 is provided between the upper edge region 56 of the transition piece 34 which is bent over outwards and the correspondingly bent part 56 of the valve or pump plate 54.

Figure 7:
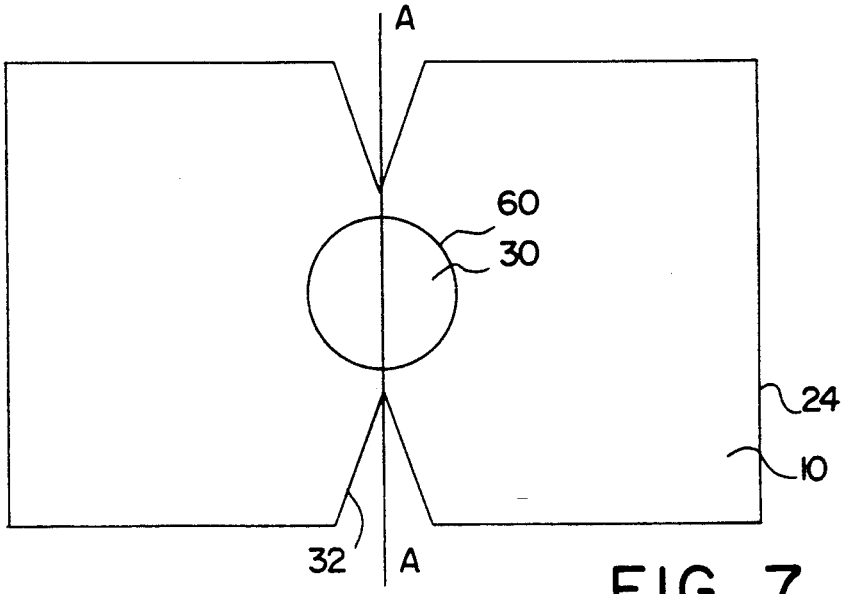
FIG. 7 shows a stamped-out laminate with opening in the region of the middle fold.

FIG. 7 shows a way of manufacturing the pouch 22. The laminate 10 stamped out of a strip and featuring the cut or stamped edges 24 define the outer contours of the pouch 22. After adhesive bonding, sealing or welding the cut or stamped out edges 24 to form seals 28, the wedge shaped parts at A—A form the inclinations 32.

Figure 7A:
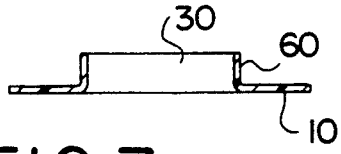
FIG. 7a shows a side-elevation of part of FIG. 7.

The centre of the pouch opening 30 lies on line A—A, the folding edge which is produced on folding both halves of the laminate 10. A pouch opening 30 with a collar 60 forming the neck of the pouch 22 is created as a result of stretch-drawing, cup drawing, and subsequent stamping. This is indicated in the part shown sectioned in FIG. 7*a*.

If the laminate 10 is folded along line A—A in the normal manner then the collar 60 formed is weakened. For that reason a template protecting the collar 60 is employed when folding the laminate 10.

The collar 60 can be secured directly in the flange of the can body 38. The collar 60 can however be shrunk onto a transition piece 34 (FIG. 3,6) which in turn is secured on or in the flange.

Figure 8:
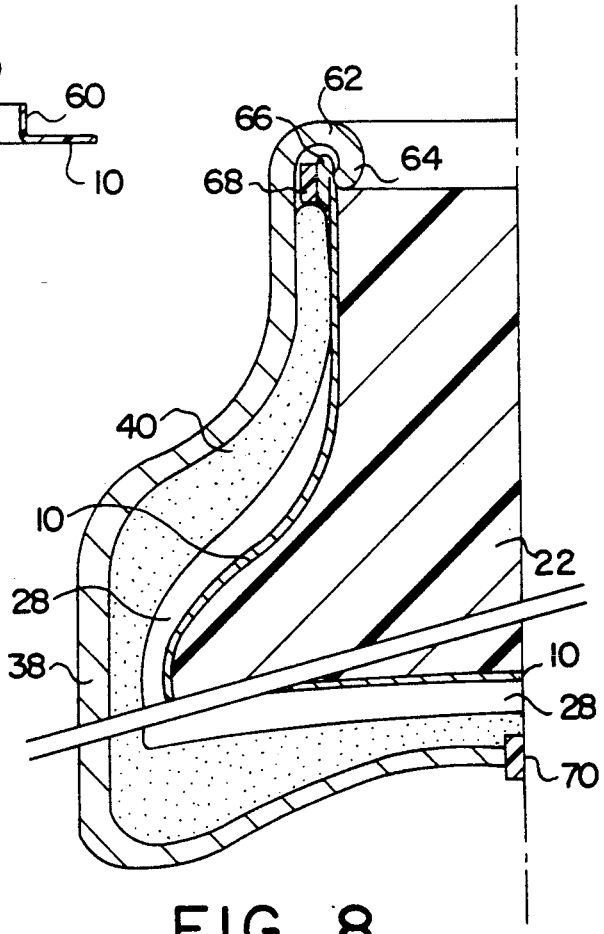
FIG. 8 shows a cross-section of part of a two-chamber dispenser with pouch in the interior held by an inward lying flanging.

FIG. 8 shows a pouch 22 without transition piece 34 (FIGS. 3, 6), which is secured in an inward-lying flange 62 of a can body 38. The sealed seam 28 is turned over in the region of the pouch opening 30. A rolled-over edge 64 provides a clamping action on the folded-over edge 66 of the laminate 10. A seal 68 is provided between the can body 38 and the folded-over sealing edge 66. This seal can be a hose-like seal, a sealing compound or a tube shaped, thermoplastic ring that is welded after installation under the influence of heat applied to the joint components. The propellant gas 40 is injected via a hole in the base of the can body 38, after the pouch 22 has been filled with its contents. The hole in the can body base is then under pressure, and is closed off using a special plug 70 for that purpose.

Of course, in a version not shown here, a transition piece 34 (FIGS. 3, 6) can be secured in the inward lying flange 62.

A filling firm receives from the can manufactures the two-chamber dispenser comprising can body with inserted, secured pouch inside (FIGS. 3, 6, 8). The contents can be introduced into the package without the filling firm having to perform any time-consuming preparation. The filling firm clinches a valve or pump plate 54 onto the can. If it is a two-chamber compression type package, then the can body has gas injected into it and then sealed.

The version of the two-chamber dispenser according to the invention ensures diffusion-free storage of the two-chamber gas pressurized or non-pressurized package.

What is claimed is:

1. Two-chamber dispenser for a gas-pressurized or non-pressurized package comprising: a rigid or semi-rigid one-piece can body with a shoulder forming an outwards lying flange which forms a flanged opening; a flexible inner pouch inserted therein of a material that forms a barrier to diffusion, said pouch being for liquid, pasty or creamy contents; wherein the pouch is made of a laminate and includes a pouch neck defining a pouch opening in the region of the flanged opening; said dispenser being suitable after the pouch has been filled, for clinching-on a valve or pump plate to said flanged opening; said dispenser including a separate transition piece that is sealed to the outwards lying flange and the opening of the flexible pouch, such that the laminate extends up to a connection the transition piece makes with the flanged opening wherein the transition piece is suitable for engaging with a valve or pump plate.

2. Two-chamber dispenser according to claim 1 wherein the flexible pouch comprises a single-piece, folded strip of laminate with sealed edges.

3. Two-chamber dispenser according to claim 2 including inclinations on said pouch corresponding approximately to the flanged opening.

4. Two-chamber dispenser according to claim 2 wherein said sealed edges are bonded.

5. Two-chamber dispenser according to claim 2 wherein said sealed edges are bent-over.

6. Two-chamber dispenser according to claim 1 wherein the flexible pouch includes a core layer selected from the group consisting of aluminum, a ductile aluminum alloy, a polyamide, ethyl-vinyl-alcohol and polyvinyl chloride plus at least one sealable inner layer and an outer layer.

7. Two-chamber dispenser according to claim 6 wherein the core layer is pure aluminum.

8. Two-chamber dispenser according to claim 6 wherein the inner layer is polyethylene.

9. Two-chamber dispenser according to claim 6 wherein the outer layer is polyethylene-terephthalate.

10. Two-chamber dispenser according to claim 1 wherein the pouch is shrunk onto the transition piece.

11. Two-chamber dispenser according to claim 1 wherein said transition piece is plastic.

12. Two-chamber dispenser according to claim 1 wherein the transition piece is a coextruded layer with diffusion-barrier properties.

13. Two-chamber dispenser according to claim 12 wherein said coextruded layer has a metallized surface.

14. Two-chamber dispenser according to claim 1 wherein said pouch has a sealed seam which is removed in the region of the pouch opening.

15. Two-chamber dispenser according to claim 1 in which the upper edge of the transition piece above the laminate is made to lie outwards in accordance with the geometric form of the outwards-lying flanging and is sealed onto the same.

16. Two-chamber dispenser according to claim 15 in which a bent-over inner surface of the transition piece is shaped into a ring-shaped projection for a valve or pump plate which is to be clinched-on.

17. Two-chamber dispenser according to claim 1 in which the neck of the pouch is shaped out of a collar of the laminate.

18. Two-chamber dispenser according to claim 1 wherein at least one of the transition piece or collar of the laminate is clamped in an inward-lying flange, such that the rolled-over edge acts directly on said at least one of the transition piece and collar.

19. Two-chamber dispenser according to claim 18 wherein a material selected from the group consisting of a hose-like seal, a sealing compound, and a ring-shaped thermoplastic ring is welded between the at least one of the transition piece and the collar and the can body.

* * * * *